US010272704B2

(12) United States Patent
Tamai

(10) Patent No.: US 10,272,704 B2
(45) Date of Patent: Apr. 30, 2019

(54) MEDIUM SUPPORTING DEVICE AND PRINTING APPARATUS

(71) Applicant: SEIKO EPSON CORPORATION, Tokyo (JP)

(72) Inventor: Satoshi Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/846,064

(22) Filed: Dec. 18, 2017

(65) Prior Publication Data

US 2018/0178563 A1 Jun. 28, 2018

(30) Foreign Application Priority Data

Dec. 27, 2016 (JP) ..... 2016-252563
Aug. 31, 2017 (JP) ..... 2017-166547

(51) Int. Cl.
*B65H 31/20* (2006.01)
*B41J 13/10* (2006.01)

(52) U.S. Cl.
CPC ..... *B41J 13/106* (2013.01); *B65H 31/20* (2013.01); *B65H 2405/1134* (2013.01); *B65H 2405/11151* (2013.01); *B65H 2405/11164* (2013.01)

(58) Field of Classification Search
CPC ..... B65H 31/20; B65H 31/02; B65H 2405/11151; B65H 2405/11164; B41J 31/106
See application file for complete search history.

(56) References Cited

U.S. PATENT DOCUMENTS

| | | | | |
|---|---|---|---|---|
| 6,231,043 | B1 * | 5/2001 | James, III | B41J 13/106 271/161 |
| 8,448,942 | B2 * | 5/2013 | Otani | B65H 31/02 271/213 |
| 9,409,734 | B2 * | 8/2016 | Tahara | B65H 1/08 |
| 9,855,771 | B2 * | 1/2018 | Sugiyama | B65H 31/02 |
| 9,938,107 | B2 * | 4/2018 | Nakamura | B65H 29/12 |
| 2018/0007221 | A1 * | 1/2018 | Mokuo | B65H 31/02 |

FOREIGN PATENT DOCUMENTS

| | | |
|---|---|---|
| JP | 10-316299 | 12/1998 |
| JP | 2002-226119 | 8/2002 |
| JP | 2011-037534 | 2/2011 |

* cited by examiner

*Primary Examiner* — Patrick Cicchino
(74) *Attorney, Agent, or Firm* — Workman Nydegger

(57) ABSTRACT

A discharge tray includes a main tray having a support face that supports discharged paper, and an extension tray being supported by the main tray, and being capable of movement between a storage position in which the extension tray is stored in the main tray and an extended position in which the extension tray has been moved to extend along a discharge direction of the paper from a leading end side of the main tray in the discharge direction. A pair of first projections is provided to both ends at the discharge direction leading end side of the main tray, and a pair of second projections that project upward is provided to both ends at the discharge direction leading end side of the extension tray. The pair of second projections are positioned to the inside of the pair of first projections in a width direction orthogonal to the discharge direction.

15 Claims, 8 Drawing Sheets

MEDIUM SUPPORTING DEVICE AND PRINTING APPARATUS

CROSS REFERENCES TO RELATED APPLICATIONS

The entire disclosure of Japanese Patent Application Nos. 2016-252563, filed Dec. 27, 2016 and 2017-166547, filed Aug. 31, 2017 are expressly incorporated by reference herein.

BACKGROUND

1. Technical Field

The present disclosure relates to a medium supporting device for supporting a medium such as paper, and to a printing apparatus provided with such a medium supporting device.

2. Related Art

Image forming apparatuses such as photocopiers and printers are typically provided with a paper discharge tray where paper is discharged after an image is formed thereon (for example, see JP-A-2002-226119). Such paper discharge trays are configured so as to be capable of supporting plural sheets of paper in a stacked state, and include a paper discharge tray body and an extension tray that is stored in the paper discharge tray body so as to be able to be pulled out therefrom. In cases in which the paper discharged to the paper discharge tray is longer than the paper discharge tray body in the direction of paper discharge, the length of the paper discharge tray in the direction of paper discharge can be extended by pulling the extension tray out from the paper discharge tray body.

However, in paper discharge trays such as described above the paper support face of the paper discharge tray body is flat. Thus, along a width direction orthogonal to the direction of paper discharge, variation in the positions of paper discharged onto the support face has been an issue.

SUMMARY

An advantage of some aspects of the disclosure is that a medium supporting device and a printing apparatus are provided in which variation in the width direction positions of medium discharged onto a support face can be suppressed.

The following relates to the way in which the above issues are addressed and the advantageous effects thereof.

A medium supporting device includes a support portion and an extension support portion. The support portion has a support face that supports a discharged medium. The extension support portion is supported by the support portion, and is capable of movement between a storage position in which the extension support portion is stored in the support portion and an extended position in which the extension support portion has been moved so as to extend along a discharge direction of the medium from a leading end side of the support portion in the discharge direction. First projections projecting upward above the height of the support face are provided, as a pair, at both ends of the discharge direction leading end side of the support portion so as to be inclined upward on progression toward the discharge direction side. Second projections projecting upward above the height of the support face are provided, as a pair, at both ends of the discharge direction leading end side of the extension support portion so as to be inclined upward on progression toward the discharge direction side. The pair of second projections are positioned to the inside of the pair of first projections in a width direction orthogonal to the discharge direction.

With this configuration, in cases in which the extension support portion is at the extended position and the width of medium discharged onto the support face is narrower than the distance between the pair of first projections and wider than the distance between the pair of second projections, both width direction ends of the medium discharged onto the support face ride over the pair of second projections as the pair of first projections restrict width direction movement of the medium. When this occurs, force toward the width direction inside acts on the medium, causing the medium to bend such that the width direction central portion of the medium droops down under its own weight. This enables variation in the width direction positions of medium discharged onto the support face to be suppressed.

Further, even when the extension support portion is in a stored state, both width direction ends of discharged medium ride over the first projections and the second projections such that the width direction central portion of the medium bends, and so the medium is imparted with stiffness (rigidity) as it is supported by the support portion. Thus, even when the extension support portion is in a stored state (a shortened state), a leading end portion of medium that projects beyond the support portion can be prevented from drooping downward and causing the medium to fall down under its own weight.

In the medium supporting device, walls that extend along the discharge direction are preferably provided, as a pair, at both ends of the support portion in the width direction so as to face each other across the support face.

With this configuration, width direction movement of medium discharged onto the support face can be restricted by the pair of walls.

In the medium supporting device, in a state in which the extension support portion is at the extended position, inner faces of the pair of first projections in the width direction preferably restrict movement in the width direction of any of the medium having a width that is narrower than a distance between the pair of first projections.

With this configuration, width direction movement of medium discharged onto the support face can be appropriately restricted by the inner faces of the pair of first projections in the width direction.

In the medium supporting device, in a state in which the extension support portion is at the storage position, the pair of second projections are preferably disposed at the width direction inside of the pair of first projections so as to be adjacent to the first projections, and such that the height of the second projections from the support face is lower than the height of the pair of first projections from the support face.

With this configuration, when both width direction ends of medium discharged onto the support face ride over from the pair of first projections to the pair of second projections, the medium can be bent such that the width direction central portion of the medium droops down under its own weight well-balanced in the width direction.

In the medium supporting device, the pair of second projections of the extension support portion are preferably linked together by a concave curved face.

With this configuration, when both width direction ends of medium discharged onto the support face ride over the pair of second projections, the medium can be bent such that the width direction central portion of the medium is drooped down more deeply by its own weight.

In the medium supporting device, at least one out of the pair of first projections or the pair of second projections preferably decreases in height on progression toward the width direction inside.

With this configuration, when both width direction ends of medium discharged onto the support face ride over the one out of the pair of first projections or the pair of second projections having a height that decreases on progression toward the width direction inside, the medium can be bent such that the width direction central portion of the medium droops down smoothly under its own weight.

In the medium supporting device, a pair of upstream projections are preferably provided on the support face in a state spaced apart from each other in the width direction upstream of the pair of first projections in the discharge direction.

With this configuration, when both width direction ends of the medium discharged onto the support face ride over the pair of upstream projections, the medium can be bent such that the width direction central portion of the medium droops down under its own weight at an earlier stage.

In the medium supporting device, upper faces of the pair of upstream projections are preferably inclined so as to become lower on progression toward the width direction inside.

With this configuration, when both width direction ends of medium discharged onto the support face ride over the pair of upstream projections, the medium can be bent such that the width direction central portion of the medium droops down under its own weight more effectively.

A printing apparatus includes a printing unit, a discharge port, and a support member. The printing unit is disposed inside a casing and prints on a medium. The discharge port is provided to the casing, and the medium is discharged from the discharge port after being printed on by the printing unit. The support member supports the medium discharged from the discharge port. The support member is configured by the medium supporting device configured as above.

Such configuration is able to achieve similar operation and advantageous effects to that of the medium supporting device above.

In the printing apparatus, a pair of main body projections are preferably provided in the discharge port in a state spaced apart from each other in the width direction.

In the printing apparatus, upper faces of the pair of main body projections are preferably inclined so as to become lower on progression toward the width direction inside.

With this configuration, when both width direction ends of medium discharged from the discharge port ride over the pair of main body projections, the medium can be bent such that the width direction central portion of the medium droops down under its own weight at an earlier stage and more effectively.

In the printing apparatus, the main body projections are preferably disposed to the width direction inside of the pair of first projections.

Such configuration enables the medium to maintain a curved profile even over the support portion.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Explanation follows regarding an embodiment in which a printing apparatus is embodied as an ink jet printer, with reference to the drawings.

Figure 1:
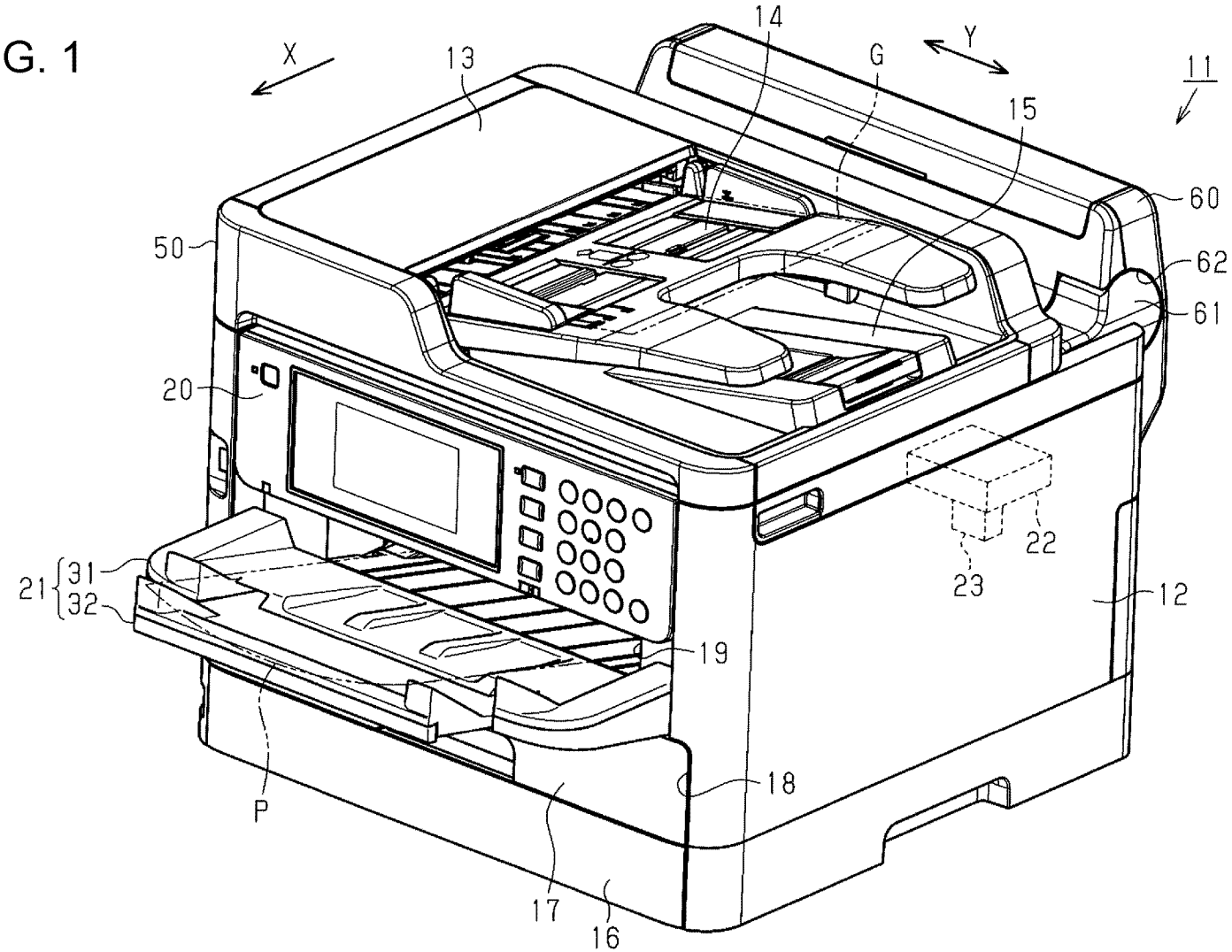
FIG. 1 is a perspective view of an ink jet printer of an embodiment.

As illustrated in FIG. 1, an ink jet printer 11, serving as an example of a printing apparatus, includes a casing 12 and a document reader 50. The height, depth, and width of the casing 12 each have a predetermined length when the ink jet printer 11 is installed at a place of use. The document reader 50 includes an automatic document feeder 13 disposed above the casing 12.

The automatic document feeder 13 includes a setting section 14 upon which plural documents G can be set in a stacked state, and a discharge section 15 disposed below the setting section 14. The plural documents G set upon the setting section 14 in a stacked state are read by a reading unit (not illustrated) disposed at an upper end section inside the casing 12 in a process in which the documents G are sequentially inverted and fed to the discharge section 15 via a document feeding path (not illustrated).

In sequence going up from a bottom side portion, a front face portion of the casing 12 is provided with an opening/closing cover 16; a loading port 18, into which a paper cassette 17 storing paper P is loaded, the paper P serving as an example of a flexible medium; a discharge port 19 from which printed-on paper is discharged; and an operation unit 20 for performing various operations. A discharge tray 21, serving as an example of a medium supporting device configuring a support member that supports printed-on paper discharged from the discharge port 19, is removably attached to the front face portion of the casing 12 so as to project out toward the front.

Here, the front face of the casing 12 refers to a side-face extending in the height and width directions, where a user performs most operations on the ink jet printer 11. In the present embodiment, the discharge direction X is the direction along which paper P is discharged from the discharge port 19, and the width direction Y a direction orthogonal to the discharge direction X. The discharge direction X and the width direction Y run substantially horizontally.

As illustrated in FIG. 1, the opening/closing cover 16 is opened/closed in order to attach or remove an ink storage body (not illustrated) that stores ink to or from the casing 12. A carriage 22 that moves to-and-fro along the width direction Y, and a recording head 23 serving as an example of a printing unit supported at a lower end portion of the carriage 22, are disposed inside the casing 12. The recording head 23 is supplied with ink from the above-described ink storage body (not illustrated).

As illustrated in FIG. 1, a projecting section 60 that projects upward and to the rear is provided to a back face portion of the casing 12 at a back face side of the casing 12. A back face paper supply unit (not illustrated) and a hinge (not illustrated) are provided inside the projecting section 60. An upper leading end of the projecting section 60 is provided with an opening that serves as a supply port for paper (medium) P for the back face paper supply unit, and a cover that opens/closes the opening is disposed at the opening. The hinge retains the document reader 50 such that the document reader 50 is able to be swung with respect to the casing 12 so as be opened/closed.

A circular-arc-shaped circular-arc protrusion 61, centered on the rotation axis of the hinge, is formed at the back face side of the document reader 50. The projecting section 60 of the casing 12 is formed with a circular-arc-shaped circular-arc recess 62, against which the circular-arc protrusion 61 formed to the document reader 50 is capable of sliding. The document reader 50 is opened/closed by sliding the circular-arc protrusion 61 on the side of the document reader 50 along the circular-arc recess 62 of the casing 12, with the hinge configuring the axis of rotation.

Paper P is sequentially supplied from the paper cassette 17 or the back face paper supply unit to a region that faces the recording head 23, and the paper P is printed on by ejecting ink toward the paper P from the recording head 23 moving to-and-fro along the width direction Y together with the carriage 22 as the paper P is transported along the discharge direction X by a transport unit (not illustrated). Paper P that has been printed on by the recording head 23 (printed-on paper P) is discharged from the discharge port 19 to the discharge tray 21, and is sequentially stacked and supported on the discharge tray 21.

Figure 2:
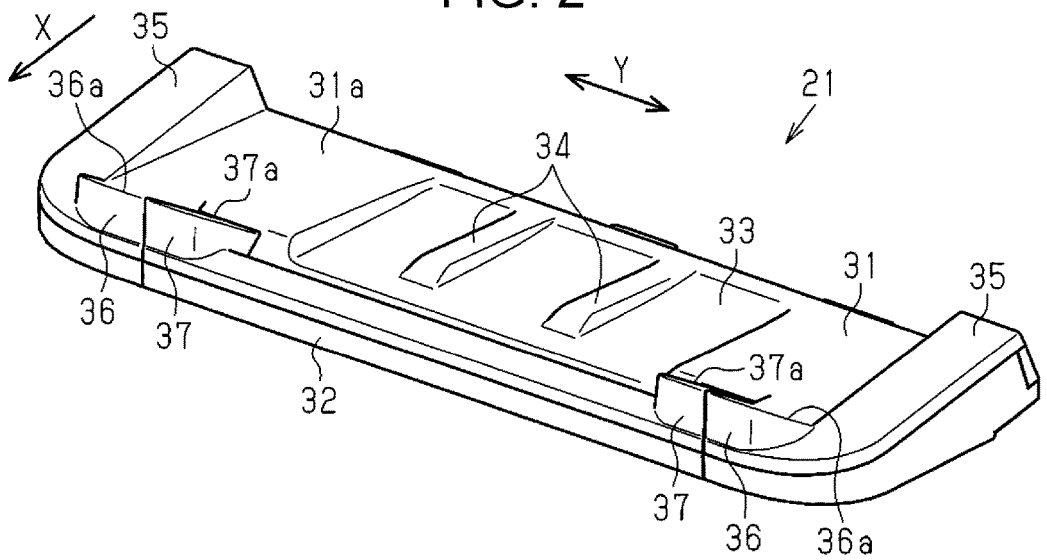
FIG. 2 is a perspective view illustrating a discharge tray of an ink jet printer in a state in which an extension support portion is at a storage position.

As illustrated in FIG. 1 and FIG. 2, the discharge tray 21 has a substantially rectangular plate shape, and includes a main tray 31 and an extension tray 32. The main tray 31 serves as an example of a support portion and includes a support face 31*a* that supports paper P discharged from the discharge port 19. The extension tray 32 serves as an example of an extension support portion and is supported by the main tray 31. The length of the extension tray 32 in the width direction Y is shorter than the length of the main tray 31 in the width direction Y.

Figure 4:
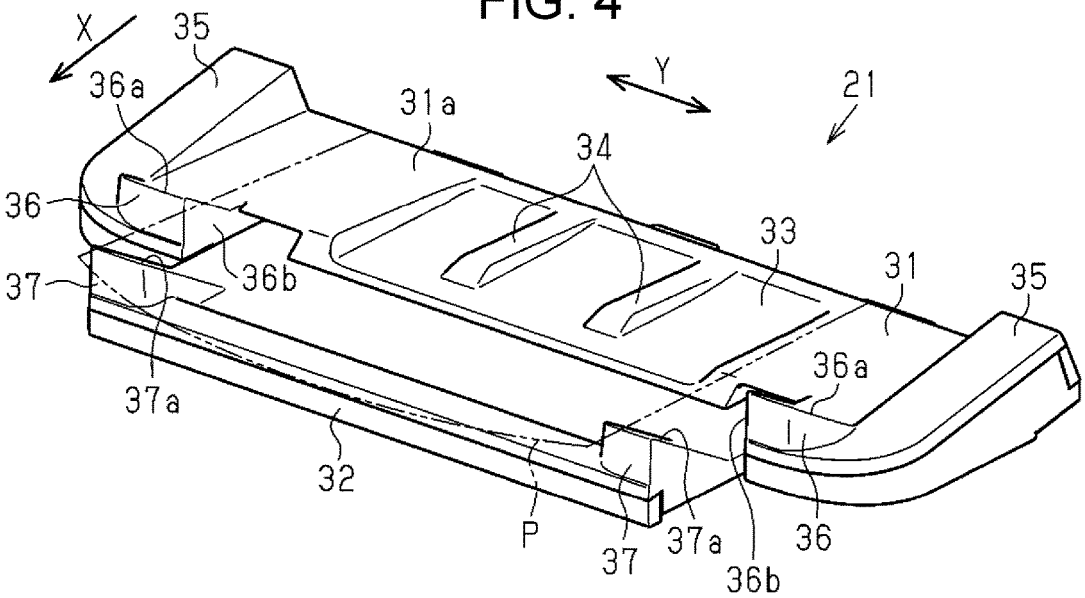
FIG. 4 is a perspective view illustrating a discharge tray of an ink jet printer in a state in which an extension support portion is at an extended position.

The extension tray 32 is capable of movement between a storage position in which the extension tray 32 is stored in the main tray 31 (the position illustrated in FIG. 2) and an extended position in which the extension tray 32 has been moved so as to extend along the discharge direction X of the paper P from a leading end side of the main tray 31 in the discharge direction X (the position illustrated in FIG. 4). In this case, an upward angle of the extension tray 32 with respect to the horizontal plane is increased slightly when the extension tray 32 is pulled out from the main tray 31 so as to move the extension tray 32 from the storage position to the extended position.

In cases in which the discharge direction X length of the paper P discharged from the discharge port 19 is comparatively long (for example, in cases in which the paper P is A4-size paper in portrait orientation), the extension tray 32 of the discharge tray 21 is moved to the extended position for use. In contrast, in cases in which the discharge direction X length of the paper P discharged from the discharge port 19 is comparatively short (for example, in cases in which the paper P is A4-size paper in landscape orientation), the extension tray 32 of the discharge tray 21 is moved to the storage position for use.

Figure 3:
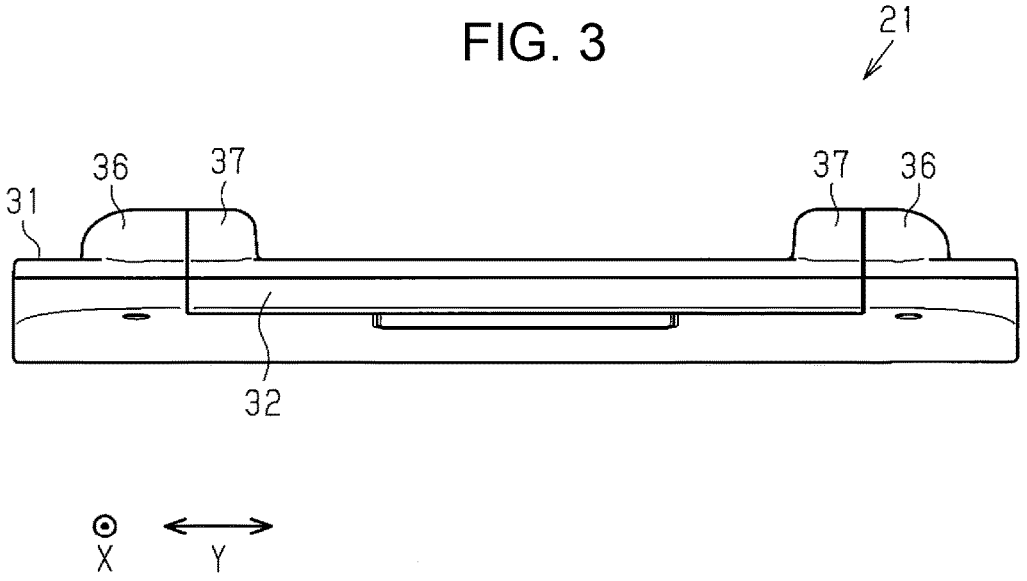
FIG. 3 is a face-on view of the configuration of FIG. 2.

As illustrated in FIG. 2 and FIG. 3, a rectangular recess 33 is formed at a central portion of the support face 31*a* of the main tray 31. A pair of ribs 34 that extend along the discharge direction X and that are spaced apart from each other in the width direction Y are formed on an inner bottom face of the recess 33. The discharge direction X sides of the recess 33 are open. Walls 35 that extend along the discharge direction X are provided, as a pair, at both ends of the main tray 31 in the width direction Y so as to face each other across the support face 31*a*.

At the discharge direction X leading end side of the main tray 31, first projections 36 that project upward above the height of the support face 31*a* are provided, as a pair, at both width direction Y ends of the main tray 31. The pair of first projections 36 are provided so as to be inclined upward on progression toward the discharge direction X side. In this case, the upper face of each of the first projections 36 configures a first inclined face 36*a* that is inclined so as to increase in height from the support face 31*a* on progression along the discharge direction X.

At the discharge direction X leading end side of the main tray 31, second projections 37 that project upward above the height of the support face 31*a* are provided, as a pair, at both width direction Y ends of the extension tray 32. The pair of second projections 37 are provided so as to be inclined upward on progression toward the discharge direction X side. In this case, the upper face of each of the second projections 37 configures a second inclined face 37*a* that is inclined so as to increase in height from the support face 31*a* on progression along the discharge direction X.

The pair of second projections 37 are positioned at the width direction Y inside of the pair of first projections 36. Namely, when the extension tray 32 is at the storage position, the pair of second projections 37 are disposed adjacent to the pair of first projections 36 at the width direction Y inside of the first projections 36. Namely, in the width direction Y, the distance between the pair of second projections 37 is shorter than the distance between the pair of first projections 36. Adjacent first inclined faces 36*a* of the first projections 36 and second inclined faces 37*a* of the second projections 37 are configured so as to be flush with each other in the width direction Y.

In the present embodiment, the distance between the pair of walls 35 is set so as to be slightly longer than the length of the long edge of a sheet of A4-size paper P; the distance between the pair of first projections 36 is set so as to be shorter than the length of the long edge of, and longer than the length of the short edge of, a sheet of A4-size paper P;

and the distance between the pair of second projections 37 is set so as to be slightly shorter than the length of the short edge a sheet of A4-size paper P. Note that the distance between the pair of second projections 37 is set so as to be shorter than the width direction Y length of paper usable by the ink jet printer 11.

Explanation follows regarding operation of the discharge tray 21 when the ink jet printer 11 is used.

As illustrated in FIG. 1 and FIG. 4, in cases in which the ink jet printer 11 is to print on A4-size paper P in portrait orientation, first, the extension tray 32 of the discharge tray 21 is pulled out from the main tray 31 and moved from the storage position to the extended position. Then, when the operation unit 20 is operated, the paper P is printed on and printed-on paper P is discharged from the discharge port 19 onto the discharge tray 21.

Namely, printed-on paper P discharged from the discharge port 19 onto the discharge tray 21 first moves along the discharge direction X over the support face 31*a*, then passes between the pair of first projections 36 en route to the pair of second projections 37. When this occurs, in cases in which the direction of movement of the paper P is offset in the width direction Y with respect to the discharge direction X, a width direction Y end of the paper P abuts a width direction Y inner face 36*b* of the first projection 36 that is positioned on the side of the offset in the direction of movement of the paper P, thereby suppressing the offset in the direction of movement of the paper P. Namely, the inner faces 36*b* of the pair of first projections 36 in the width direction Y restrict width direction Y movement of paper P having a width that is narrower than the distance between the pair of first projections 36.

Figure 5:
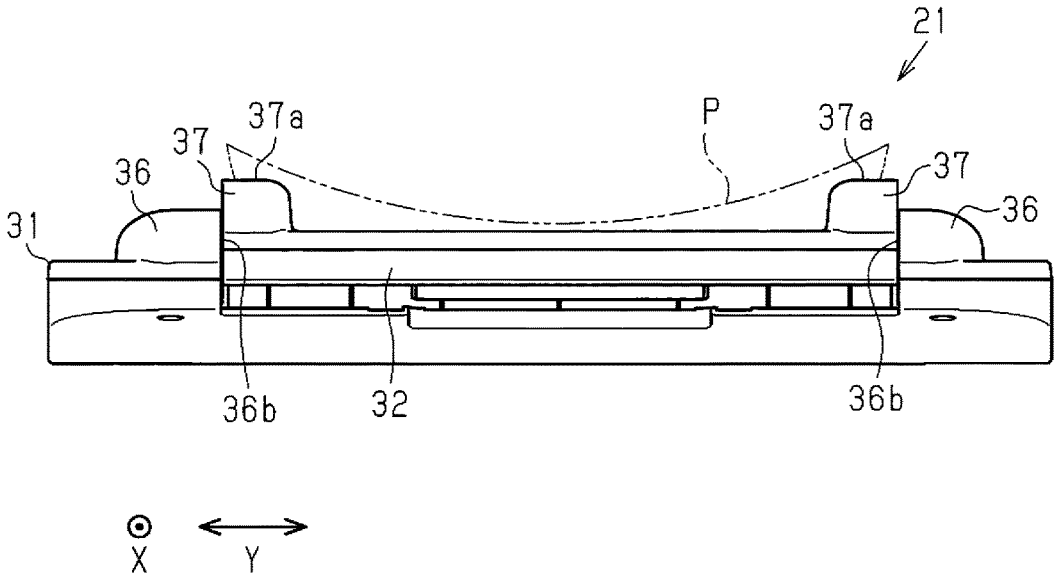
FIG. 5 is a face-on view of the configuration of FIG. 4.

Then, the paper P passing between the pair of first projections 36 and moving toward the pair of second projections 37 moves further along the discharge direction X, and as illustrated in FIG. 4 and FIG. 5, the paper P rides onto the pair of second projections 37 over the second inclined faces 37*a*. When this occurs, both width direction Y ends of the paper P are supported by the pair of second projections 37. Consequently, due to the weight of the paper P, force acts on the paper P from each width direction Y end of the paper P toward a width direction Y central portion thereof, and the paper P bends into a bow shape such that the width direction Y central portion of the paper P droops down.

The paper P is thereby supported by the pair of second projections 37 in a state balanced in the width direction Y as the paper P curves such that the central portion between the pair of second projections 37 and the width direction Y central portion of the paper P face each other in the up-down direction. Namely, even when the paper P is supported by the pair of second projections 37 in a state in which it has a positional offset in the width direction Y, the positional offset in the width direction Y is suppressed by the weight of the paper P. Accordingly, even in cases in which plural sheets of paper P are consecutively printed, variation in the width direction Y positions of the plural sheets of paper P supported in a stacked state on the discharge tray 21 is suppressed.

As illustrated in FIG. 1 and FIG. 2, in cases in which the ink jet printer 11 is to print on A4-size paper P in landscape orientation, first, the extension tray 32 of the discharge tray 21 is moved from the extended position to the storage position and stored in the main tray 31. Then, when the operation unit 20 is operated, the paper P is printed on and printed-on paper P is discharged from the discharge port 19 onto the discharge tray 21.

Namely, printed-on paper P discharged from the discharge port 19 over the discharge tray 21 moves along the discharge direction X and onto the support face 31*a*. When this occurs, in cases in which the direction of movement of the paper P is offset in the width direction Y with respect to the discharge direction X, a width direction Y end of the paper P abuts the wall 35 positioned at the side of the offset in the direction of movement of the paper P, thereby suppressing the offset in the direction of movement of the paper P. Namely, the pair of walls 35 restrict width direction Y movement of paper P having a width that is narrower than the distance between the pair of walls 35.

Note that even when discharged onto the discharge tray 21, A4-size paper P in landscape orientation will generally not reach as far as the pair of first projections 36 and the pair of second projections 37. However, if the paper P were to be discharged onto the discharge tray 21 with an unexpected amount of force, the pair of first projections 36 and the pair of second projections 37 would function as stoppers for the paper P.

The following advantageous effects are able to be obtained by the embodiment described in detail above.

(1) On the discharge tray 21, the pair of second projections 37 are positioned to the width direction Y inside of the pair of first projections 36. Thus, in cases in which the extension tray 32 is at the extended position and the width of paper P discharged onto the support face 31*a* is narrower than the distance between the pair of first projections 36 and wider than the distance between the pair of second projections 37, both width direction Y ends of the paper P discharged onto the support face 31*a* ride over the pair of second projections 37 as the pair of first projections 36 restrict width direction Y movement of the paper P. When this occurs, force toward the width direction Y inside acts on the paper P, causing the paper P to bend such that the width direction Y central portion of the paper P droops down under its own weight. This enables variation in the width direction Y positions of paper P discharged onto the support face 31*a* to be suppressed. Namely, this enables variation in the width direction Y positions of plural sheets of paper P discharged and stacked on the support face 31*a* to be suppressed. Further, even when the extension tray 32 is in a stored state, both width direction Y ends of discharged paper P ride over the first projections 36 and the second projections 37 such that the width direction Y central portion of the paper P bends, and so the paper P is imparted with stiffness (rigidity) as it is supported by the main tray 31. Thus, even when the extension tray 32 is in a stored state (a shortened state), a leading end portion of the paper P that projects beyond the main tray 31 can be prevented from drooping downward and causing the paper P to fall down under its own weight.

(2) On the discharge tray 21, the walls 35 extending along the discharge direction X are provided, as a pair, at both width direction Y ends of the main tray 31 so as to face each other across the support face 31*a*. Width direction Y movement of paper P discharged onto the support face 31*a* can accordingly be restricted by the pair of walls 35.

(3) On the discharge tray 21, in a state in which the extension tray 32 is at the extended position, the inner faces 36*b* of the pair of first projections 36 in the width direction Y restrict width direction Y movement of paper P having a width that is narrower than the distance between the pair of first projections 36. Width direction Y movement of paper P discharged onto the support face 31*a* can accordingly be appropriately restricted by the inner faces 36*b* of the pair of first projections 36 in the width direction Y.

Modified Examples

Note that the above embodiment may be modified as follows. Moreover, configuration included in the above embodiment may also be freely combined with configuration included in the following modified examples, and configuration included in the following modified examples may be freely combined together.

Figure 6:
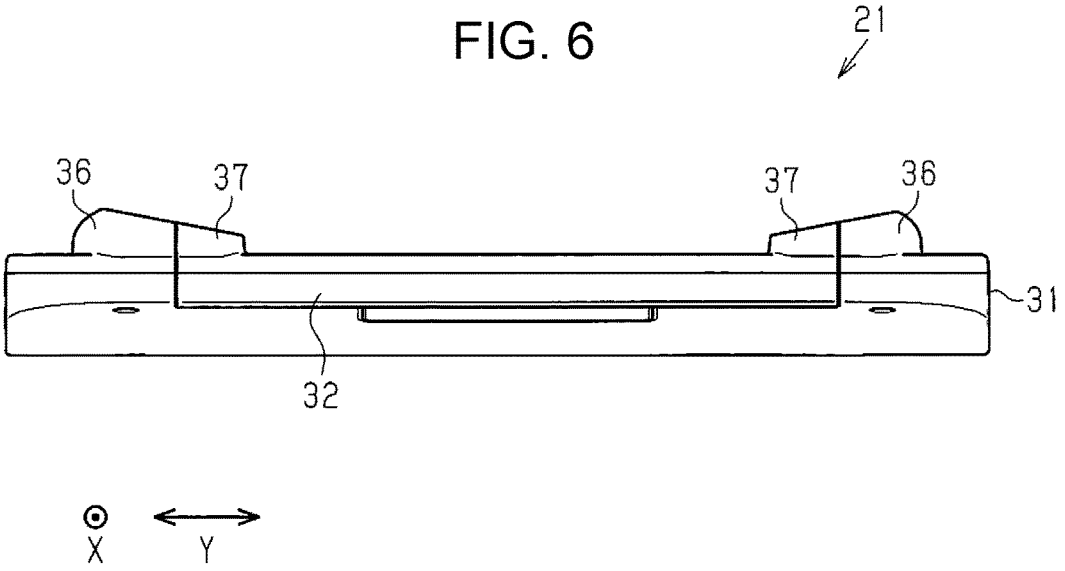
FIG. 6 is a face-on view of a discharge tray of a modified example.

As illustrated in FIG. 6, the pair of first projections 36 and the pair of second projections 37 of the discharge tray 21 may be configured such that their heights decrease on progression toward the width direction Y inside. By doing so, when both width direction Y ends of paper P discharged onto the support face 31*a* ride over the pair of first projections 36 and the pair of second projections 37, the paper P can be bent such that the width direction Y central portion of the paper P droops down smoothly under its own weight. In such cases, the pair of first projections 36 and the pair of second projections 37 may be configured such that their heights decrease in steps on progression toward the width direction Y inside. Alternatively, either the pair of first projections 36 or the pair of second projections 37 of the discharge tray 21 may be configured such that their height decreases on progression toward the width direction Y inside. By doing so, when both width direction Y ends of paper P discharged onto the support face 31*a* ride over whichever out of the pair of first projections 36 or the pair of second projections 37 has a height that decreases on progression toward the width direction Y inside, the paper P can be bent such that the width direction Y central portion of the paper P droops down smoothly under its own weight. In such cases, either the pair of first projections 36 or the pair of second projections 37 may be configured such that their height decreases in steps on progression toward the width direction Y inside.

Figure 7:
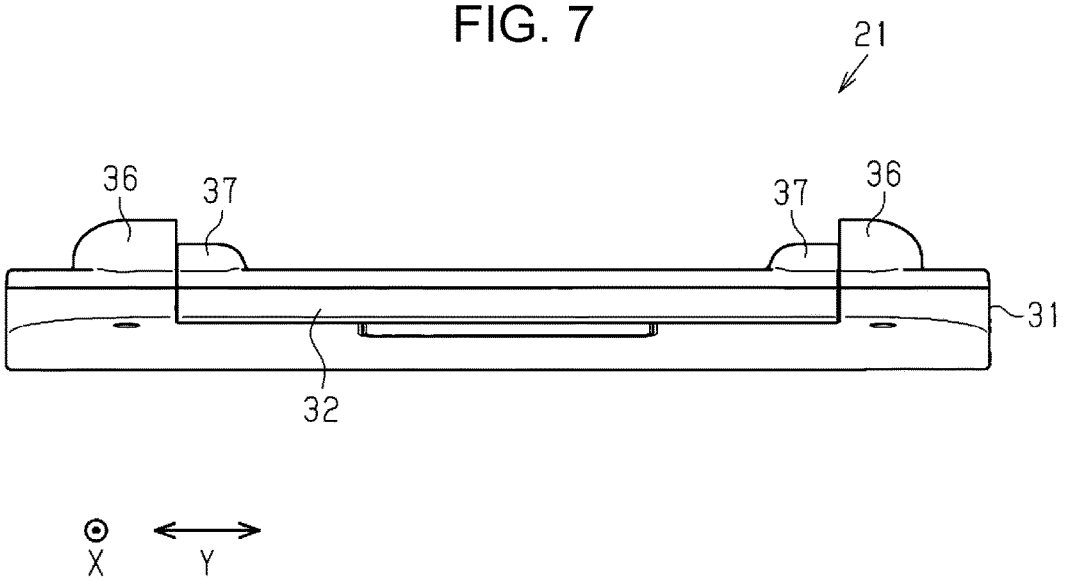
FIG. 7 is a face-on view of a discharge tray of a modified example.

As illustrated in FIG. 7, the pair of second projections 37 of the discharge tray 21 may be configured having a height from the support face 31*a* that is lower than the height of the pair of first projections 36 from the support face 31*a*. By doing so, when both width direction Y ends of paper P discharged onto the support face 31*a* ride from the pair of first projections 36 to the pair of second projections 37, the paper P can be bent such that the width direction Y central portion of the paper P droops down under its own weight well-balanced in the width direction Y.

Figure 8:
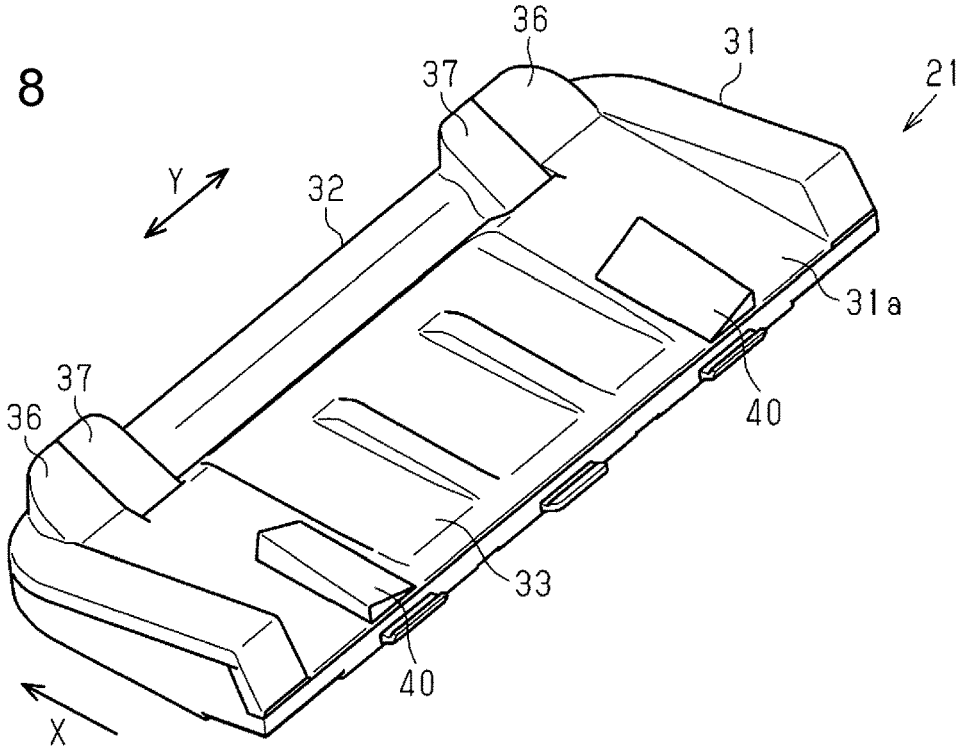
FIG. 8 is a perspective view illustrating a discharge tray of a modified example in a state in which an extension tray is at a storage position.
Figure 9:
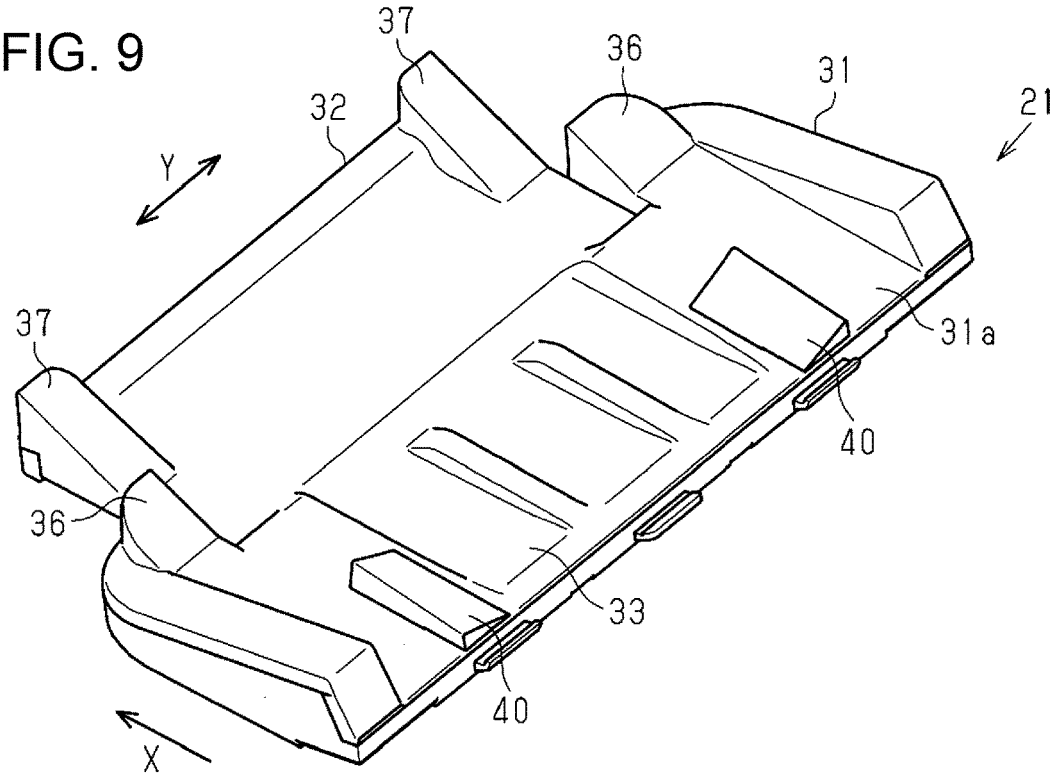
FIG. 9 is a perspective view illustrating the discharge tray of FIG. 8 in a state in which the extension tray is at an extended position.

As illustrated in FIG. 8 and FIG. 9, on the discharge tray 21, a pair of upstream projections 40 may be provided on the support face 31*a* in a state spaced apart from each other in the width direction Y upstream of the pair of first projections 36 in the discharge direction X. In such cases, the pair of upstream projections 40 are disposed so as to face each other in the width direction Y across the recess 33, and such that a width direction Y interval therebetween is just slightly narrower than the interval between the pair of second projections 37. Further, the pair of upstream projections 40 are wedge shaped, and are each inclined such that the height of an upper face decreases on progression toward the width direction Y inside. By doing so, when both width direction Y ends of paper P discharged onto the support face 31*a* ride over the pair of upstream projections, the paper P can be bent such that the width direction Y central portion of the paper P droops down under its own weight at an earlier stage and more effectively.

Figure 10:
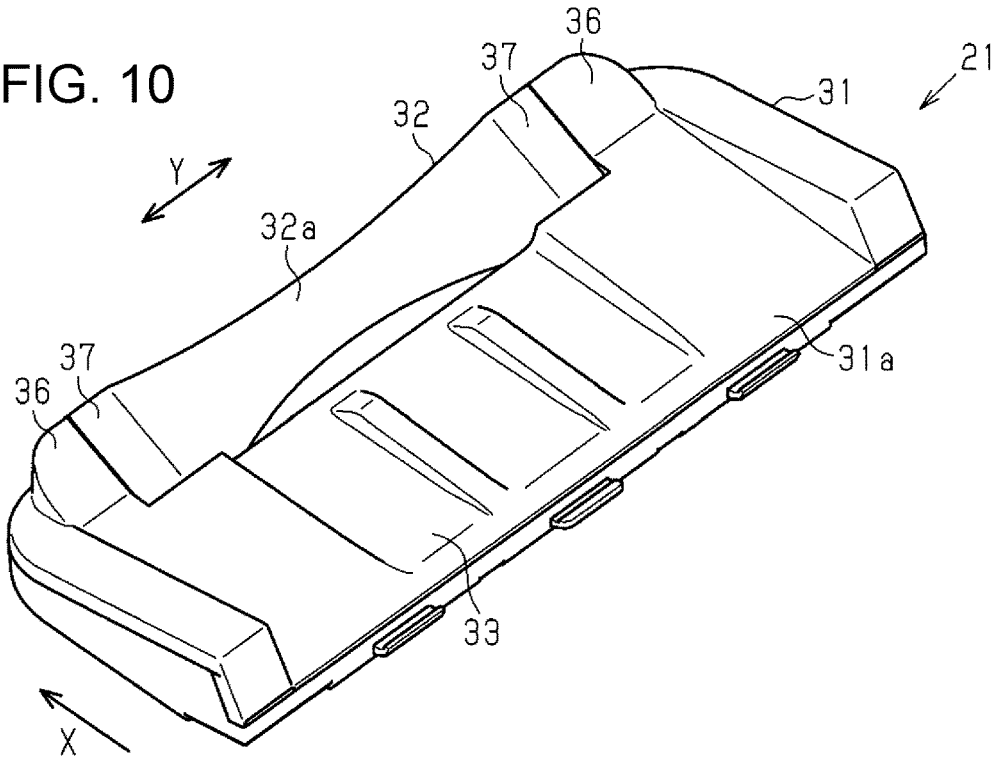
FIG. 10 is a perspective view illustrating a discharge tray of a modified example in a state in which an extension tray is at a storage position.
Figure 11:
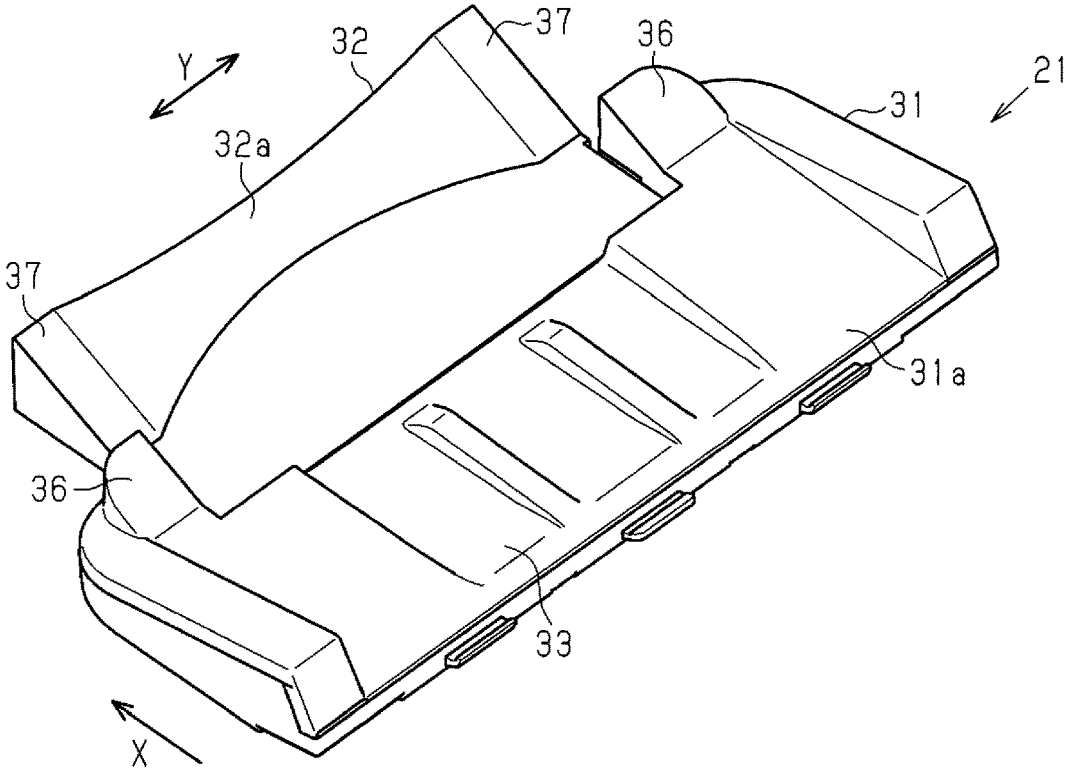
FIG. 11 is a perspective view illustrating the discharge tray of FIG. 10 in a state in which the extension tray is at an extended position.

As illustrated in FIG. 10 and FIG. 11, on the discharge tray 21, configuration may be such that a concave curved face 32*a* is formed between the pair of second projections 37 of the extension tray 32. By doing so, when both width direction Y ends of paper P discharged onto the support face 31*a* ride over the pair of second projections 37, the paper P can be bent such that the width direction Y central portion of the paper P is drooped down more deeply by its own weight.

Figure 12:
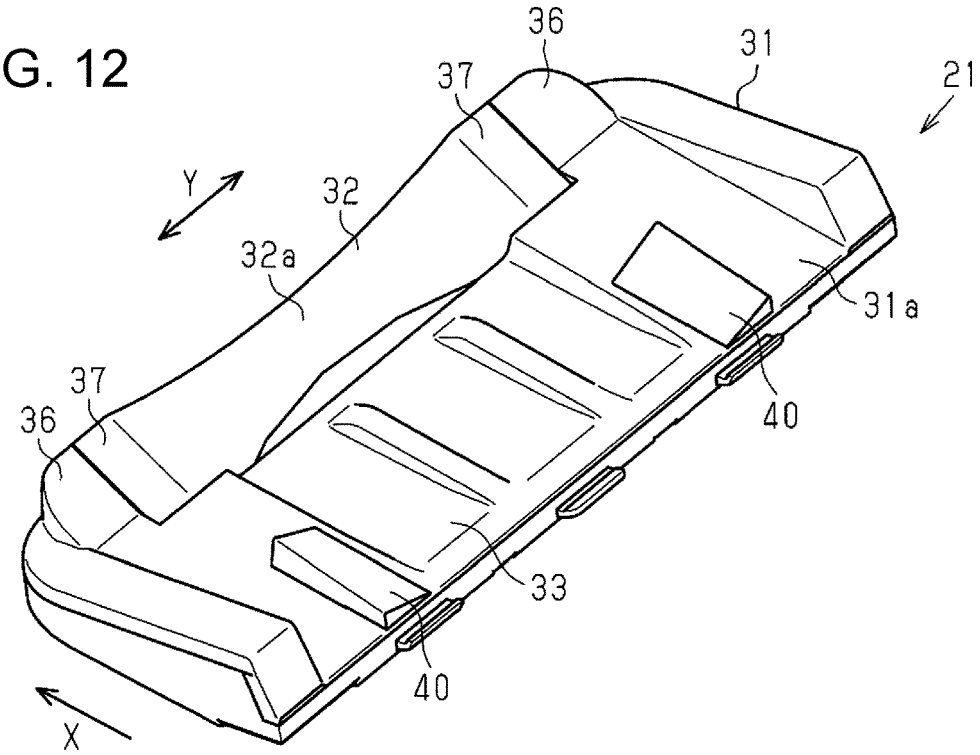
FIG. 12 is a perspective view illustrating a discharge tray of a modified example in a state in which an extension tray is at a storage position.
Figure 13:
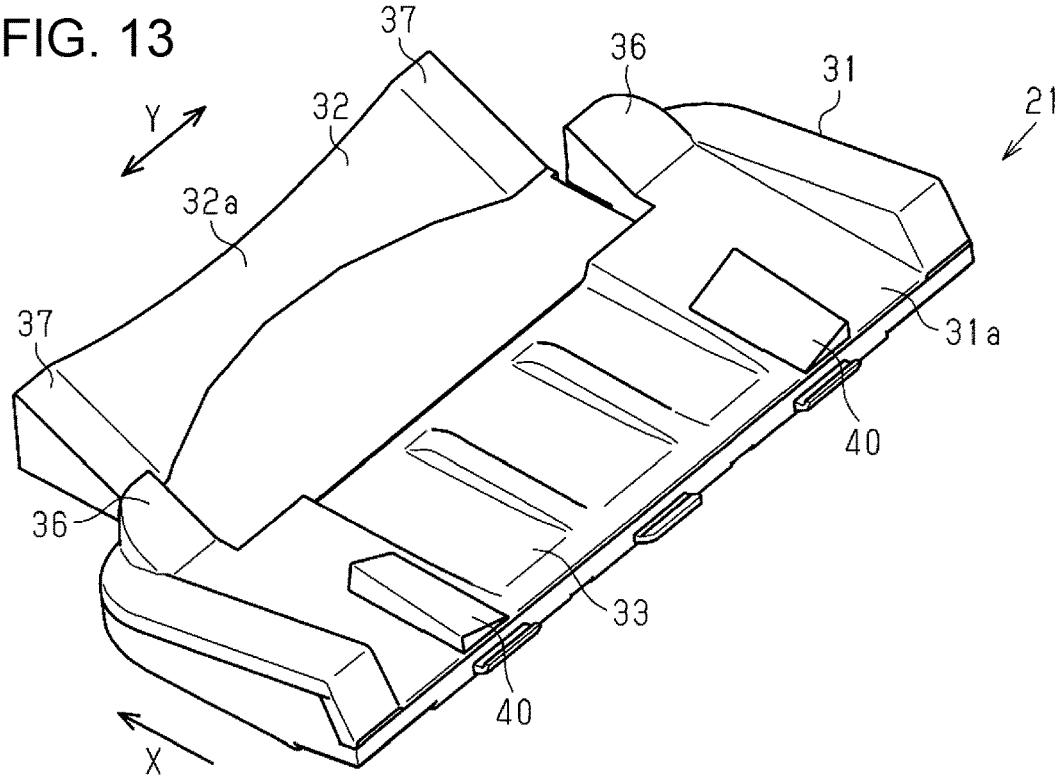
FIG. 13 is a perspective view illustrating the discharge tray of FIG. 12 in a state in which the extension tray is at an extended position.

As illustrated in FIG. 12 and FIG. 13, on the discharge tray 21, configuration may be such that the discharge tray 21 described above and illustrated in FIG. 8 and FIG. 9 is combined with the discharge tray 21 described above and illustrated in FIG. 10 and FIG. 11. Namely, on the discharge tray 21, the pair of upstream projections 40 may be provided on the support face 31*a* in a state spaced apart from each other in the width direction Y upstream of the pair of first projections 36 in the discharge direction X, and the concave curved face 32*a* may be formed between the pair of second projections 37 of the extension tray 32. Doing so enables both the advantageous effect of the discharge tray 21 described above and illustrated in FIG. 8 and FIG. 9 and the advantageous effect of the discharge tray 21 described above and illustrated in FIG. 10 and FIG. 11 to be achieved.

Figure 14:
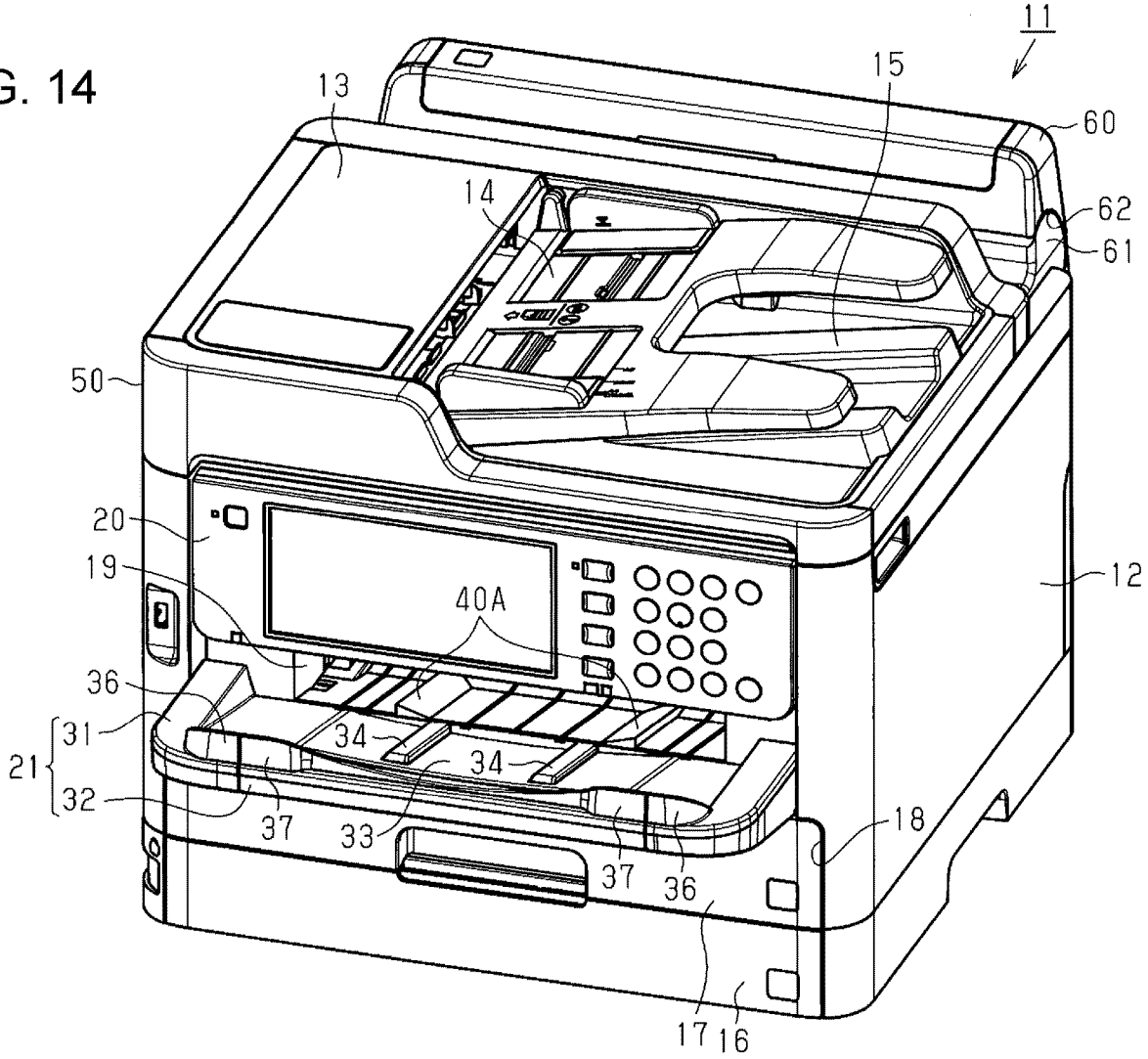
FIG. 14 is a perspective view of an ink jet printer of a modified example.

As illustrated in FIG. 14, configuration may be such that a pair of main body projections 40A are provided in the discharge port 19 of the ink jet printer 11 in a state spaced apart from each other in the width direction Y. In such cases, the upstream projections 40 provided on the support face 31*a* of the discharge tray 21 illustrated in FIG. 8, for example, may be either present or absent. It is preferable that the main body projections 40A have the same shape as the upstream projections 40 provided on the support face 31*a* of the discharge tray 21 illustrated in FIG. 8, and that upper faces of the pair of main body projections 40A are inclined so as to become lower on progression toward the width direction Y inside. With such configuration, when both width direction Y ends of paper P discharged from the discharge port 19 ride over the pair of main body projections 40A, the paper P can be bent such that the width direction Y central portion of the paper P droops down under its own weight at an earlier stage and more effectively. Note that the main body projections 40A are preferably disposed at the width direction Y inside of the pair of first projections 36 provided on the main tray 31, and when viewed from the discharge port 19, the wedge shaped inclined faces of the main body projections 40A are preferably contiguous to upper faces of the ribs 34 provided on the main tray 31. Such configuration enables the paper P to maintain a curved profile even over the main tray 31.

The pair of walls 35 may be omitted.

In a state in which the extension tray 32 is at the extended position, the inner faces 36*b* of the pair of first projections 36 in the width direction Y do not necessarily have to restrict width direction Y movement of paper P having a width that is narrower than the distance between the pair of first projections 36.

The medium is not limited to paper P, and may, for example, be plastic film.

The medium supporting device (discharge tray 21) may be applied to the discharge section 15 from which documents G (medium) are discharged after being read in the automatic document feeder 13.

The printing apparatus may be a laser printer.

What is claimed is:

1. A medium supporting device comprising:

a support portion having a support face that supports a discharged medium; and an extension support portion that is supported by the support portion, and that is capable of movement between a storage position in which the extension support portion is stored in the support portion and an extended position in which the extension support portion has been moved so as to extend along a discharge direction of the medium from a leading end side of the support portion in the discharge direction, wherein a pair of first projections projecting upward above the height of the support face is provided at both ends of the discharge direction leading end side of the support portion so as to be inclined upward toward the discharge direction side, a pair of second projections projecting upward above the height of the support face is provided at both ends of the discharge direction leading end side of the extension support portion so as to be inclined upward toward the discharge direction side, and the pair of second projections is positioned to the inside of the pair of first projections in a width direction orthogonal to the discharge direction, wherein the pair of second projections of the extension support portion are linked together by a concave curved face directly between the pair of second projections.

2. The medium supporting device according to claim 1, wherein a pair of walls that extend along the discharge direction is provided at both ends of the support portion in the width direction so as to face each other across the support face.

3. The medium supporting device according to claim 1, wherein, in a state in which the extension support portion is at the extended position, inner faces of the pair of first projections in the width direction restrict movement in the width direction of any of the medium having a width that is narrower than a distance between the pair of first projections.

4. The medium supporting device according to claim 1, wherein, in a state in which the extension support portion is at the storage position, the pair of second projections are disposed at the width direction inside of the pair of first projections so as to be adjacent to the first projections, and such that the height of the second projections from the support face is lower than the height of the pair of first projections from the support face.

5. The medium supporting device according to claim 1, wherein at least one out of the pair of first projections or the pair of second projections decreases in height on progression toward the width direction inside.

6. The medium supporting device according to claim 1, wherein a pair of upstream projections are provided on the support face in a state spaced apart from each other in the width direction upstream of the pair of first projections in the discharge direction.

7. The medium supporting device according to claim 6, wherein upper faces of the pair of upstream projections are inclined so as to become lower on progression toward the width direction inside.

8. A printing apparatus comprising:

a printing unit that is disposed inside a casing and that prints on a medium;

a discharge port that is provided to the casing, and from which the medium is discharged after being printed on by the printing unit; and a support member that supports the medium discharged from the discharge port, the support member being configured by the medium supporting device according to claim 1.

9. The printing apparatus according to claim 8, wherein a pair of main body projections are provided in the discharge port in a state spaced apart from each other in the width direction.

10. The printing apparatus according to claim 9, wherein upper faces of the pair of main body projections are inclined so as to become lower on progression toward the width direction inside.

11. The printing apparatus according to claim 10, wherein the main body projections are disposed to the inside of the pair of first projections in the width direction.

12. A medium supporting device comprising:

a support portion having a support face that supports a discharged medium; and an extension support portion that is supported by the support portion, and that is capable of movement between a storage position in which the extension support portion is stored in the support portion and an extended position in which the extension support portion has been moved so as to extend along a discharge direction of the medium from a leading end side of the support portion in the discharge direction, wherein a pair of first projections projecting upward above the height of the support face is provided at both ends of the discharge direction leading end side of the support portion so as to be inclined upward toward the discharge direction side, a pair of second projections projecting upward above the height of the support face is provided at both ends of the discharge direction leading end side of the extension support portion so as to be inclined upward toward the discharge direction side, and the pair of second projections is positioned to the inside of the pair of first projections in a width direction orthogonal to the discharge direction, wherein, in a state in which the extension support portion is at the storage position, the pair of second projections are disposed at the width direction inside of the pair of first projections so as to be adjacent to the first projections, and such that the height of the second projections from the support face is lower than the height of the pair of first projections from the support face.

13. A printing apparatus comprising:

a printing unit that is disposed inside a casing and that prints on a medium;

a discharge port that is provided to the casing, and from which the medium is discharged after being printed on by the printing unit, wherein a pair of main body projections are provided in the discharge port in a state spaced apart from each other in a width direction orthogonal to the discharge direction; and a support member that supports the medium discharged from the discharge port, the support member comprising:

a support portion having a support face that supports a discharged medium; and an extension support portion that is supported by the support portion, and that is capable of movement between a storage position in which the extension support portion is stored in the support portion and an extended position in which the extension support portion has been moved so as to extend along a discharge direction of the medium from a leading end side of the support portion in the discharge direction, wherein a pair of first projections projecting upward above the height of the support face is provided at both ends of the discharge direction leading end side of the support portion so as to be inclined upward toward the discharge direction side, a pair of second projections projecting upward above the height of the support face is provided at both ends of the discharge direction leading end side of the extension support portion so as to be inclined upward toward the discharge direction side, and the pair of second projections is positioned to the inside of the pair of first projections in the width direction orthogonal to the discharge direction.

14. The printing apparatus according to claim 13, wherein upper faces of the pair of main body projections are inclined so as to become lower on progression toward the width direction inside.

15. The printing apparatus according to claim 13, wherein the main body projections are disposed to the inside of the pair of first projections in the width direction.

* * * * *